US005878742A

United States Patent [19]

Figueredo et al.

[11] Patent Number: 5,878,742

[45] Date of Patent: Mar. 9, 1999

[54] AIRVISOR DELIVERY SYSTEM

[76] Inventors: Joseph P. Figueredo, 562 Lakeland Plaza, Suite 238, Cummings, Ga. 30130; Robert E. Weir, P.O. Box 309, Verbena, Ala. 36901

[21] Appl. No.: 927,172

[22] Filed: Sep. 11, 1997

[51] Int. Cl.[6] ..... A62B 18/04; A42B 3/28; A42B 3/22

[52] U.S. Cl. ..... 128/201.24; 128/201.25; 128/205.29

[58] Field of Search ..... 128/201.24, 201.25, 128/205.29

[56] References Cited

U.S. PATENT DOCUMENTS

| | | | |
|---|---|---|---|
| 2,032,101 | 2/1936 | Sullivan | 128/201.25 |
| 3,822,698 | 7/1974 | Guy | 128/201.25 |
| 4,136,688 | 1/1979 | Gorman | 128/201.25 |
| 4,280,491 | 7/1981 | Berg et al. | 128/201.24 |
| 4,462,399 | 7/1984 | Braun | 128/201.25 |
| 4,730,612 | 3/1988 | Dumpney | 128/201.24 |
| 4,752,974 | 6/1988 | Haino | 128/201.24 |
| 5,054,479 | 10/1991 | Yelland et al. | 128/201.25 |
| 5,104,430 | 4/1992 | Her-Mov | 128/205.29 |
| 5,533,500 | 7/1996 | Her-Mou | 128/201.25 |
| 5,577,495 | 11/1996 | Murphy | 128/201.24 |
| 5,592,936 | 1/1997 | Thomas et al. | 128/206.12 |

*Primary Examiner*—John G. Weiss
*Assistant Examiner*—Joseph F. Weiss, Jr.
*Attorney, Agent, or Firm*—Veal & Associates

[57] ABSTRACT

An air delivery system including a means for defining a plenum near the forehead of a wearer, a baffle for distributing the air from the plenum downward over the wearer's mouth, nose, and face, and a means for securing the plenum to the forehead of the wearer, such as a safety helmet, a cap visor, or a pair of safety eye glasses. The brim of the helmet or visor defines the upper portion of the plenum, and a baffle defines the lower portion. The baffle has openings to distribute the air downward over the wearer's face. In the case of the safety glasses, the baffle has an upper portion and a lower portion forming a plenum between them due to a slightly concave shape of the baffle portions. An inlet nozzle is connected to the plenum through the baffle, baffle portions, or the brim, and a small motor and fan assembly is connected to the inlet nozzle via a flexible hose. In operation, the motor draws air through a filter element and distributes the filtered air via the hose to the plenum. The baffle then distributes the air flow over the wearer's breathing zone thereby protecting the wearer from particulate matter or harmful substances in the ambient environment.

28 Claims, 4 Drawing Sheets

Fig. 1
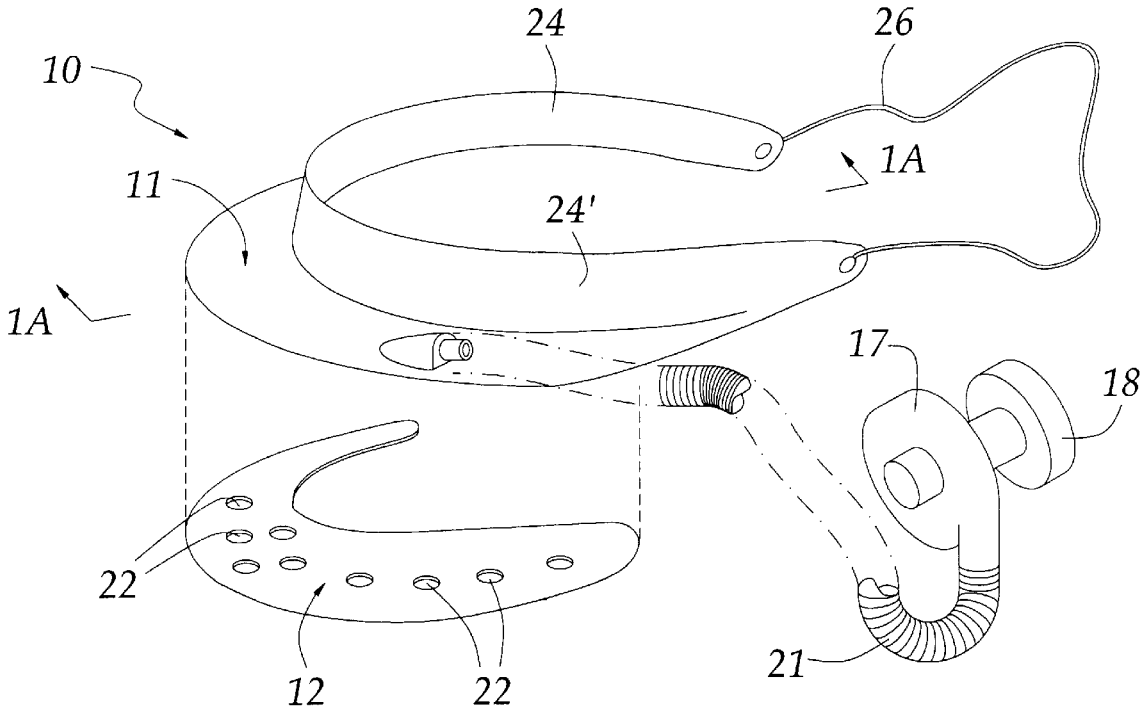
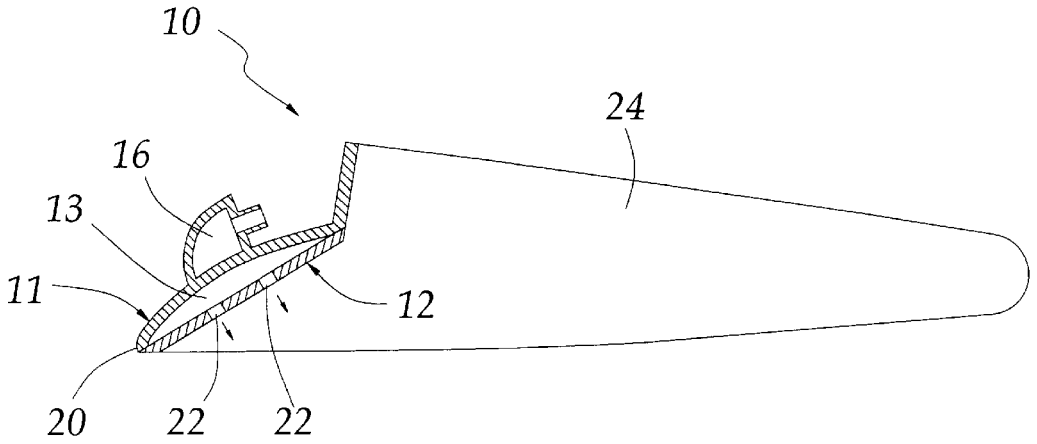
Fig. 1A

Fig. 2
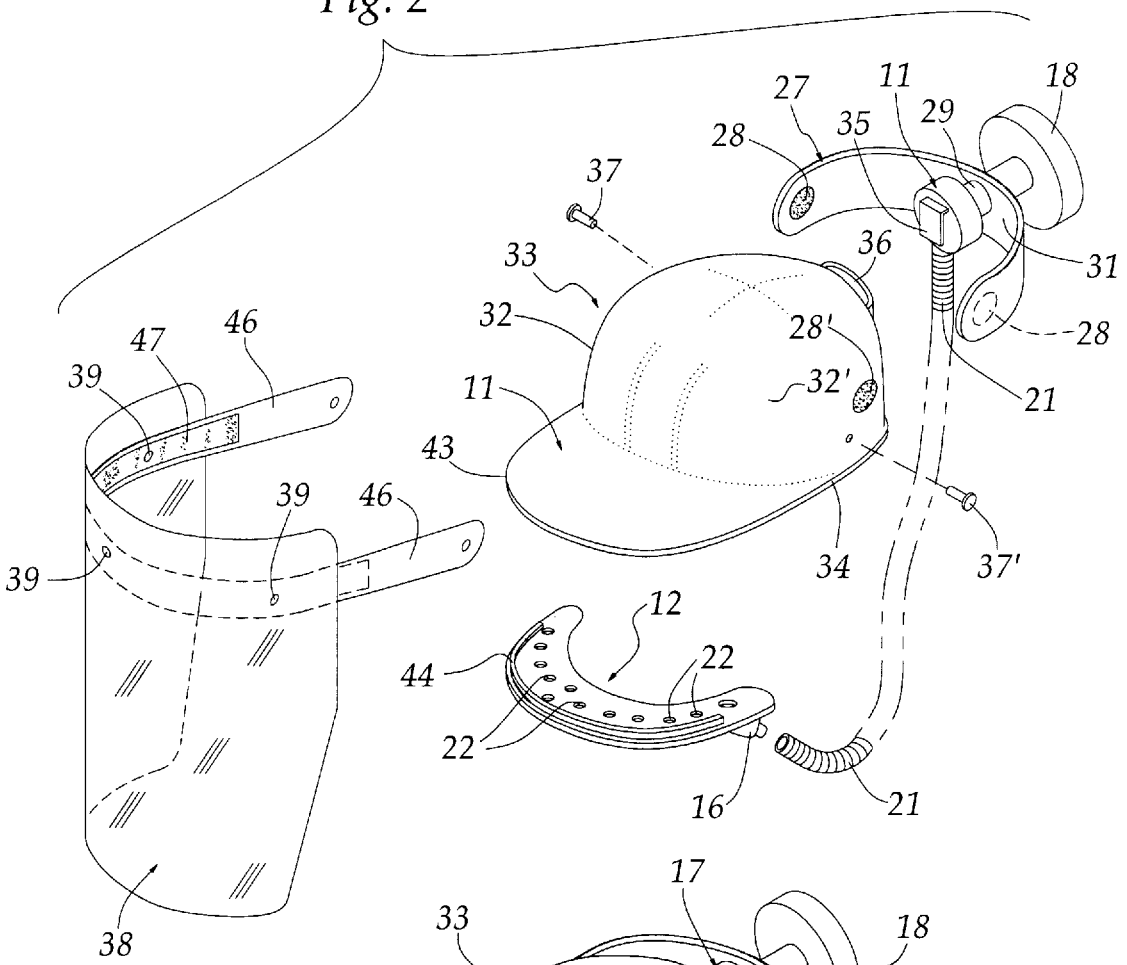
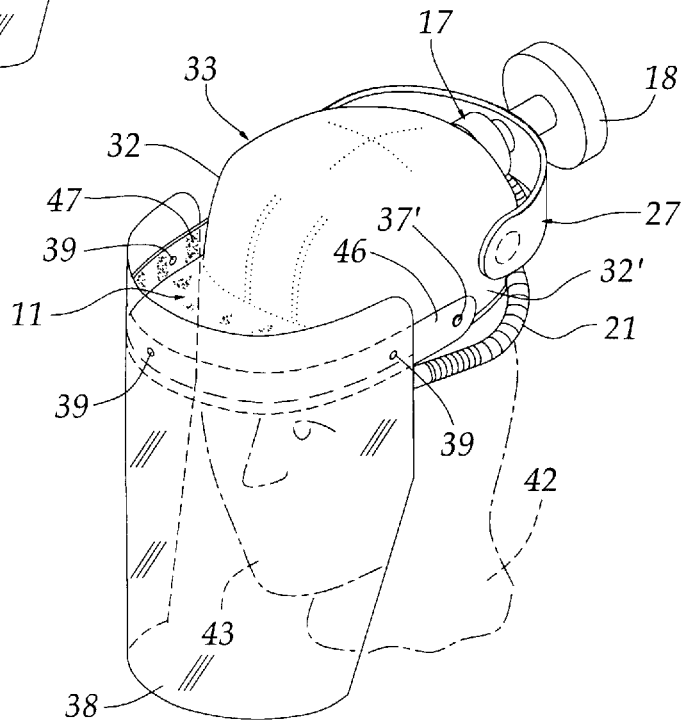
Fig. 2A

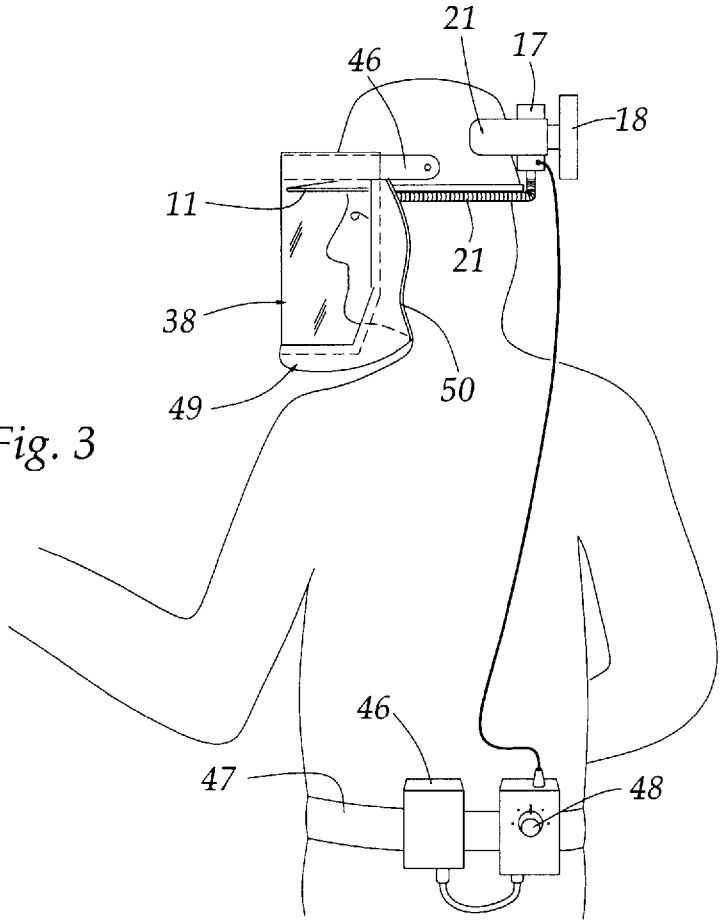
Fig. 3
Fig. 4
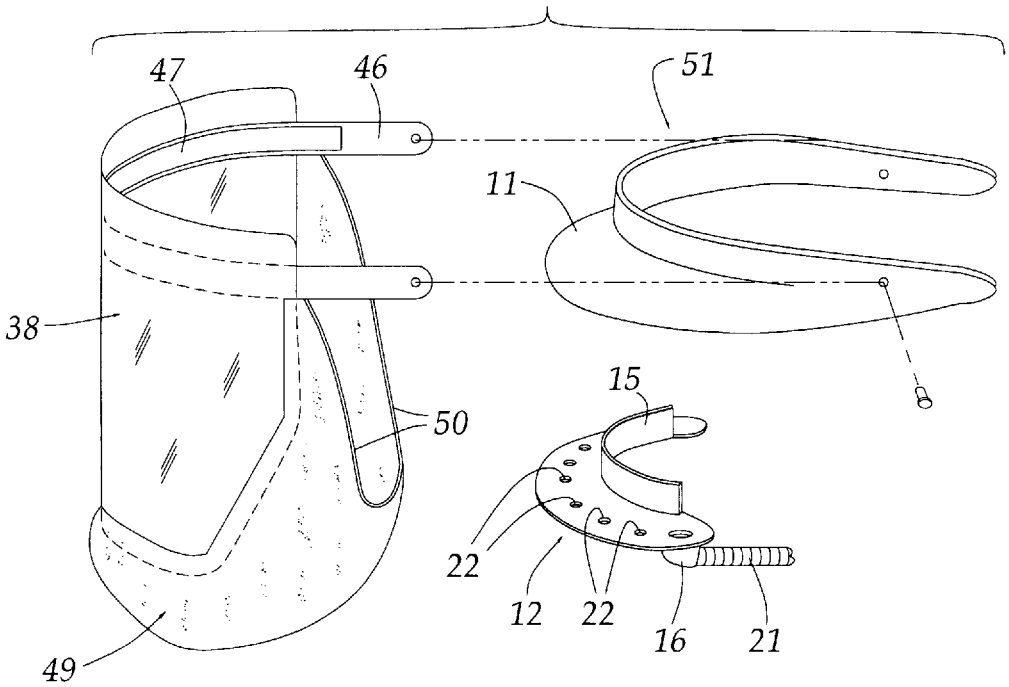

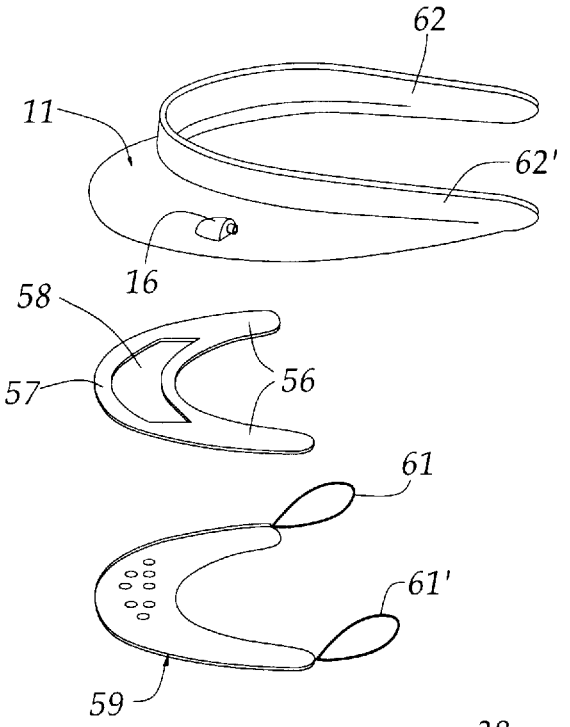
Fig. 6
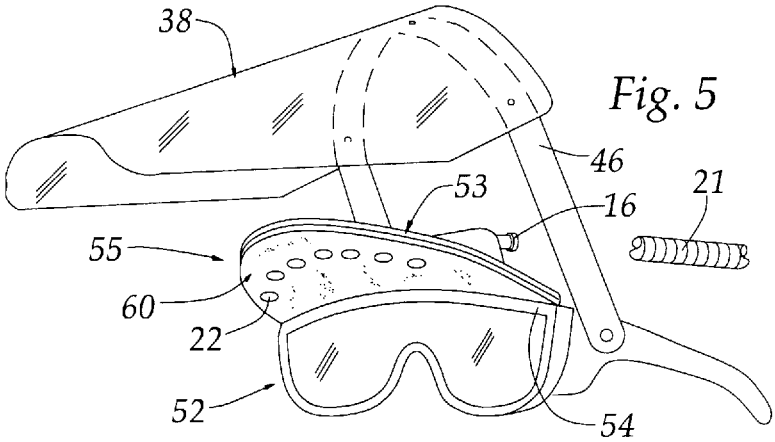
Fig. 5
Fig. 7
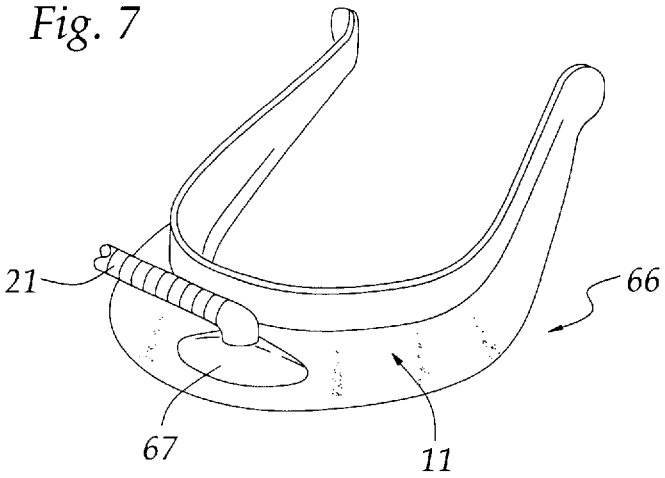

AIRVISOR DELIVERY SYSTEM

FIELD OF THE INVENTION

The present invention relates generally to respirators. In particular, this invention relates to respirators using a battery operated fan assembly to produce a positive air flow of filtered air over a wearer's facial breathing zone.

BACKGROUND OF THE INVENTION

Devices for respiratory protection have accelerated in recent decades. The health care and industrial work place industries have a need for practical, economical and effective devices for delivering clean or filtered respirable air as a means of protection from environmental contaminants. Agriculture also is in need of protection as it applies to ambient work place contaminants. Allergy sufferers and the more severe environmentally sensitive individuals could greatly benefit from low-cost convenient respiratory devices that do not add any additional respiratory stress. Currently, the largest percentage of the respiratory protection market is represented by the disposable and half mask cartridge negative pressure respirator. However, in recent years, new studies have demonstrated that negative pressure respirators offer limited protection as exposure limits for many substances and particulates are lowered by various approval agencies such as the Occupational Safety and Health Administration (OSHA) as well as the Center for disease Control (CDC). In response, many occupational professionals are selecting the positive pressure Powered Air Purifying Respirator.

Negative pressure respirators can be inherently uncomfortable, leading to less user wear time. A respirator that is not worn or is not worn correctly has a protection factor of zero. Negative pressure respirators increase respiratory stress, and must be fit tested. A fit check must be performed each time the respirator is donned. Facial hair eliminates the use of a negative pressure respirator. Disposable and half mask cartridge respirators have the lowest protection factor rating compared to all other types of respirators including the Powered Air Purifying Respirator.

Conversely, Powered Air Purifying Respirators (PAPRs) are not dependent upon the wearer's breathing capacity and avoid many of the noted implementation problems. PAPRs use small battery operated motor and fan assemblies to produce filtered, respirable air by drawing ambient air through a filter element. The respirable air is then distributed through various distribution strategies to the user's facial breathing zone, namely the nose and mouth area. A positive pressure of 5–12 cu. ft./min. is maintained in typical systems which displaces any contaminated air in the breathing zone of a wearer.

Since PAPRs are positive pressure devices, they eliminate the potential for pulmonary stress in a user. PAPR systems can be constructed to be simply, easily attachable devices delivering respirable air to a user. Since no special seals need be created on the user, PAPRs avoid any problems due to improper donning or inadequate fit problems. PAPR filters typically have larger surface areas than disposable filters and last longer than the disposable sort. Also, disposable respirators are typically discarded immediately after use, increasing the cost over the longer lasting, reusable, PAPR filters. PAPR devices offer broader protection in industry because they can be used for substance filtration in addition to simple particulate removal. Because of the forgoing, integration of PAPRs into an employee protection system is more easily accomplished than their disposable counterparts.

In terms of emergency respiratory apparatus, PAPRs may be used as a companion device under certain conditions. Escape type respirators are simple and small, often utilizing a belt mounted compressed air cylinder. A full face mask or other type of head piece may be used, but generally a clear plastic hood is utilized. During an emergency, such as a release of a toxic substance, escape respirators are donned, sometimes necessitating the doffing of a non-emergency type respirator. Risk inherent in escape type respirators include the inability to don the emergency respirator quickly enough. Exhausting the emergency air supply (usually 5–15 minutes of air) before reaching a safe area is of critical importance. Light weight PAPRs such as a shield or visor could make a combination escape apparatus and a workplace PAPR companion that would utilize the air purifying features of the PAPR during normal work shifts, and provide escape features for emergency situations. The combination air delivery device and escape apparatus would eliminate doffing and donning procedures. At the end of useful service life of the escape apparatus, the PAPR could once again be used to continue the orderly escape using filter media design optimized for escape situations.

In firefighting, a Self Contained Breathing Apparatus (SCBA) could be used during the initial stages of structural firefighting, after which time an air delivery system could be attached to the firefighter's helmet to aid in respiratory protection from contaminates associated with clean-up, ventilation and inspection.

Even with the inherent advantages of PAPRs, current PAPR systems are expensive and cumbersome when compared with disposable and half mask cartridge respirators. Most systems are integrated into safety helmets during manufacturing, adding unavoidable cost. Other types of PAPRs utilize head covers, such as the above mentioned helmet, as well as hoods, shrouds, and completely fabricated helmeted welding systems. These systems provide positive air flow that often include the head neck and face areas of the individual user. In these cases, filtered air may be contaminated by the hair and skin of the user prior to respiration.

Typically the bulky helmeted loose fitting devices have few aesthetic features and little retail acceptance. Innovations of the head piece assembly, as it applies to the PAPR, is seriously lacking in both the industrial work place and in the health care industry.

Another drawback with current systems is that they are relatively expensive to implement. Helmets or hoods of various sizes and shapes must be inventoried by the organization using the PAPRS, thereby necessitating the purchase of relatively expensive pre-manufactured PAPRS. These PAPRs then replace other types of relatively low cost and user accepted protective gear, such as, but not limited to, the standard construction helmet or unrespirated miner's helmet.

Other than current industrial PAPRs, low-cost, low-complexity, comfortable PAPRs for casual or retail health use are non-existent. Also, there have been few innovations in current PAPR inlet covers. Conversely, personal protection devices such as safety eye wear, head protection, and hearing protection have made major strides in design and function. Light weight, practical and cosmetically appealing appliances are now the norm in these fields. However, one only needs to see the bulky, helmeted, hood, and loose fitting shrouds that are typical of the PAPR headpiece to appreciate the fact that aesthetics and retail acceptance have heretofore not been considerations. These drawbacks are a result of the over complexity of current PAPR systems and lack of industry innovation.

Absent from the arsenal of PAPRs presently found in the market place are respiratory systems that may be incorporated into existing conventional personal safety products such as helmets, safety eyeware, face shields, caps, headbands, welding shields, all presently used on a wide scale as the result of product innovation and design. The environmentally sensitive, many who are house bound, have few retail products that consider the need for aestically but inconspicuous designs that offer the advantages of a PAPR, yet may be worn in public places.

Moreover, the health care industry has need to replace the half masks currently used. Half-masks are uncomfortable to wear over extended periods and do not provide the broad range protection needed in today's health care environments. The health care industry is currently attempting to implement PAPR type devices, but has been slow to adopt them due to problems associated with intimidating appearance of the apparatuses, cost of disposable headpieces, and general incompatibility with the typical dress normally associated with a health care worker.

In conjunction with the discussed industry needs and retail market opportunities, legislation is taking form that will promote the utilization of PAPRs. New OSHA federal regulations will mandate new protections for "bio-aerosols" such as MDR tuberculosis, and new NIOSH regulations proscribe certain disposable respirators unless specially approved HEPA filter media are incorporated. Furthermore, industry continues to debate the validity of protection factors established by NIOSH, ANSI, and other committees, as they apply to negative pressure, half-mask and disposable respirator systems. This confusion over the validity of protection factors tends to diminish the desire to implement half-mask and disposable respirators in a system-wide fashion.

Therefore, there is a strong need for a PAPR that can be economically incorporated into preexisting, conventional protective gear, such as safety helmets or protective eye wear. There is also a strong need for a simple and economical, retail oriented PAPR which can be adapted for application specific uses, and for casual use of PAPRs.

SUMMARY OF THE INVENTION

It is the object of the present invention to provide an apparatus to supply respirable air to the breathing zone of a wearer.

It is a further object of the invention to provide a respirator using a battery operated motor and fan assembly to produce a positive flow of filtered air over a wearer's facial breathing zone.

It is another object of the present invention to provide a respirator that can be easily attached to a conventional safety helmet to provide respirable air to its wearer.

A further object of this invention is to provide an apparatus that will integrate with various types of hats, visors, protective eye-wear, and other forms of head attachments to provide respirable air to the wearer at the breathing zone.

Briefly, the invention includes a means for defining a plenum near the forehead of a wearer using a baffle for distributing the air from the plenum downward over the wearer's mouth, nose, and face, and a means for securing the plenum to the forehead of the wearer, such as a safety helmet, cap visor, or a pair of safety eye glasses. Typically, the plenum will be defined on an upper portion by the brim of the helmet or the visor brim, and defined on a lower portion by the baffle which both defines part of the plenum and distributes air downward. In the case of the safety glasses, a small visor element is supported by and extends from the top portion of the glasses and a baffle attached underneath this visor element defines the lower portion of the plenum. An inlet nozzle is connected to the plenum by protruding through the brim or through the baffle, and a hose connects a small motor and fan assembly to the inlet nozzle. In operation, the motor draws air through a filter element and distributes the filtered air via the hose to the plenum. The baffle then distributes the air flow over the wearer's breathing zone.

Other features and objects and advantages of the present invention will become apparent from a reading of the following description as well as a study of the appended drawings.

BRIEF DESCRIPTION OF THE DRAWINGS

An air delivery system, incorporating the features of the invention, is depicted in the attached drawings which form a portion of the disclosure and wherein:

FIG. 1 is an exploded perspective view of the most prominent components of the invention integrated into a conventional visor;

FIG. 1A is a sectional view of the brim, baffle, nozzle, and plenum areas of the invention;

FIG. 2 is an exploded perspective view of the invention integrated into a safety helmet (hard hat) in which all of the components are detachable;

FIG. 2A is a perspective view of the assembled helmet.

FIG. 3 is a perspective view of a wearer after donning a safety helmet incorporating the invention and showing the placement of the various elements of the invention on the wearer;

FIG. 4 is an exploded perspective view of the invention integrated into a visor and showing a face shield extending downward and a face seal;

FIG. 5 is a perspective view of the invention integrated into a pair of safety glasses;

FIG. 6 is an exploded perspective view of the invention integrated into a visor with a flexible baffle frame and fabric covering; and, FIG. 7 is a perspective view of the invention integrated into a visor where the visor and baffle are one molded piece.

DESCRIPTION OF THE PREFERRED EMBODIMENTS

Referring to the drawings for a better understanding of the function and structure of the invention, FIG. 1 shows the major elements of the invention 10. A means for defining a plenum includes of a brim 11 of a visor or other head attachment and a baffle 12 attached below the visor. The visor and the baffle are formed so that an air plenum 13 is created between them as shown more clearly in FIG. 1A. The plenum 13 is fully enclosed by the visor lower surface 20 and the baffle. An inlet nozzle 16 protrudes through the visor brim 11 for supplying air to the plenum. A motor and fan assembly 17 draws ambient air through a filter element 18 removing particulate matter or harmful gases from the air, depending upon the type of filter utilized, and urges the newly filtered, respirable air through a flexible hose 21 to the nozzle 16. Due to the positive pressure created by the fan 17, air enters into plenum 13 and is forced downward through perforations 22 and over the breathing zone of a wearer. The perforations 22 are preferably positioned so that respirable air from the plenum 13 is focused advantageously. However, while simple apertures or perforations are shown, other types of openings in the baffle may be utilized to optimize the distribution of air toward the breathing zone. For securing the plenum on the wearer, the visor has side members 24, 24' which extend back over the head of the wearer and a strap 26 helps to secure the visor to the wearer's head. The composition of the invention components is inconsequential, but preferably may be made from low cost injection molded plastics as is well known in the art.

FIG. 2 shows a miner's safety helmet 33 with the invention integrated into the helmet. A bonnet 27 has ends detachably supported by hook and pile fastening means 28, 28' affixed to the side portions of the helmet 32, 32'. The motor and fan assembly 17 has a support clip 35 which fastens to the rear portion of the helmet in a detachable clip pocket 36. The air intake portion 29 of the fan assembly protrudes through an aperture at a rearmost point 31 of the shroud 27 and also supports the filter element 18. Air hose 21 is affixed to nozzle 16 at one end and to the fan and motor assembly at the other end. The hose 21 is sufficiently tight between the fan and nozzle such that the hose is slightly biased against the side brim 34 of the helmet 33 as is more clearly shown in the FIG. 2A. Baffle 12 has a reverse curled flange 44 that is cooperatively formed with the periphery 43 of brim 11 such that the baffle may be mounted on the brim and remain biased against the underside of the brim 11. The flange 44 overlaps a sufficient marginal portion of brim 11 such that the flange is frictionally held in place. Optionally, a strap 46 with sealing gasket 47 may be rotatably attached to the side portions of 32, 32' of the helmet 33 with detachable plastic rivets 37, 37' to bias the baffle 12 more tightly against the brim 11 (see FIG. 2A). A flexible face shield 38 can be supported on strap 46 by three snap-on buttons 39 and extends downward over the wearer's face 41 and upper neck area 42. The strap 46 and the rivets 37, 37' provide enough frictional resistance and rigidity such that the face shield may be inclined up and away from the users face 41 as desired. Optionally, a sealing gasket may be affixed to the inside surface of strap 46 so that upon inclining the shield 38 into the downward position the strap is biased against the periphery 43 of brim 11, thereby preventing ambient air from entering the facial area from behind the strap 46. FIG. 2A shows the assembled helmet with face shield inclined into the down position covering the wearer's face 43 and upper neck area 42. Since all of the components of the invention can be made to be detachably affixed to the helmet, existing stores of safety helmets already in operation may used in conjunction with the invention to create the PAPR.

FIG. 3 shows a worker having donned the invention after integration into a miner's helmet. A battery 46 for powering the motor and fan assembly 17 is supported on belt 47. The wearer is shown with the face shield 38 lowered into the downward position. A face seal 49 for preventing ambient air from entering into the facial area is also shown. The face seal provides additional protection to the wearer by preventing ambient air from entering behind the face shield 38 into the wearer's breathing zone. Any implementation of the invention can incorporate a face seal as long as a suitable seal can be made along the periphery of the face shield 38 extending downward over the user's face. Due to the constant flow of positive pressured air distributed by the baffle 12, ambient air is prevented from entering into the breathing zone of the wearer. A face seal provides additional protection from ambient air intrusion into the breathing zone by creating a pocket of respirable air behind the seal and preventing any possibility of ambient air being entrained into the air stream from the baffle and into the breathing zone of the wearer.

FIG. 4 shows the invention used with a visor 51 with the nozzle 16 integrated into the baffle 12. Visor 51 has a rigid baffle 12 with apertures 22 for directing the respirable air downward. Baffle 12 is affixed to brim 11 via gluing, plastic riveting, or other suitable means, and forms the plenum between them. The baffle 12 may incorporate an upwardly extending back panel 15 that connects to a rear-most point of the brim to better define the plenum. In this embodiment, the motor and fan assembly and filter element may be mounted on the wearer anywhere that is suitable such as on the belt 47 as shown in FIG. 3. The hose 21 may be corrugated as shown in all the figures to facilitate positioning on the wearer to connect it to the motor and fan assembly 17. A face shield 38 may be attached in the same way as with the miner's helmet embodiment of FIG. 2. That is, with detachable rivets. Optionally, a face seal 49 may be attached along the periphery of the face shield and an elastic band sown into a back of the seal to form a resilient portion 50 which urges the rear of the periphery against the wear's upper neck area as was shown in FIG. 3.

The invention is not limited to incorporation with visors and helmets. FIG. 5 shows the invention being used with a pair of safety eye glasses 52. A visor element 55 has an upper portion 53 and lower portion 60 which are supported by the top portion 54 of the glasses. Baffle element 12 is affixed to the visor element 55 by any suitable means, such as gluing, and due to the slightly concave nature of the baffle and visor element, a plenum is created between them. Although not shown, visor element 55 may be detachably secured upon top portion 54 with simple clips or clamps as known in the art, thereby allowing the baffle to be detached and re-attached when the PAPR is needed. Other elements of the invention such as the nozzle 16 protruding into the plenum, apertures 22 for distributing air over the wearer's face, the face shield and hose 21 connecting a motor and fan assembly to the nozzle 16 are the same as disclosed in the previous embodiments, and can also be detachably secured to the glasses. Supporting head straps, in the form of a harness (not shown), may be needed to better secure the glasses 52 and face shield 38 to the head of the wearer. In order to prevent the nozzle 16 from obscuring the view of the wearer, it is preferable to position the nozzle on top portion of the baffle 55. The air hose may be captured by the head straps as it leaves the nozzle and travels in an arc over the head.

An alternate version of the invention integrated into a visor is shown in FIG. 6. In place of a planar baffle 12 with apertures 22 as previously shown in FIGS. 1 and 4, the baffle may be formed into a flexible base frame portion 56 with a flexible arcuate strip 57 curving outward from the base frame. The base frame and strip define an open space 58 between them. A piece of fabric material 59 is then secured over this air space covering it. Side straps 61, 61' attached to ends of the fabric 59 apply tension to the sides of the fabric to secure it to the baffle frame and are attached to side members 62,62' of the visor 11 in a suitable fashion to keep the material tight against the baffle frame 56. The fabric 59 has a plurality of apertures in the air space area so that respirable air forced into the plenum 13 is directed downward over the wearer's face, as previously described. The fabric can be manufactured with suitable foraminous characteristics, so that some filtering is accomplished at the baffle itself by minimizing the aperture size. These fabric pieces would most likely be simple, disposable strips which are exchanged on the baffle frame as needed. Applicant envisions embodiments in which fabric with proper filtering characteristics can be used in lieu of a separate filter element connected to the motor and fan assembly. While not suitable for all environments, large size particulate contaminants such as plastic shavings that are produced in sawing, drilling, and working of plastic materials can be filtered out of the fan supplied air as it passes through the fabric from the plenum. This obviates the need for a separate filter element.

While it has been shown that a plenum may be defined by a lower surface of a visor or brim of a helmet in conjunction with a baffle below, the invention is not so limited. As shown in FIG. 7, a satisfactory plenum can be defined by the lower surface of the brim 11 of a visor 66 alone. Typically motor and fan assemblies for PAPR masks nominally provide 6–9 cu.-ft./Min. of respirable air to the nozzle 16. At this flow capacity, satisfactory amounts of respirable air can be delivered to a wearer's breathing zone diluting ambient air without a separate distributing baffle. As shown in the figure, a slight adjustment to the nozzle shape 67 will satisfactorily distribute the respirable air more widely over the wearer's facial area. An economical retail version of the invention may be implemented in this fashion and be utilized by the causal wearer, such as for persons suffering from hay fever during allergy season or for reducing fogging of face shields. Assemblies of this type could be utilized in odor control applications, as well.

While I have shown my invention in several forms, it will be obvious to those skilled in the art that it is not so limited but is susceptible of various changes and modifications without departing from the spirit thereof.

Having set forth the nature of the present invention, what is claimed is:

1. An air delivery system comprising:

a. means for defining a plenum proximal the forehead of a wearer and extending outwardly therefrom, said defining means having and upper surface and a lower surface, with a baffle member extending over a portion of said lower surface;

b. means for providing respirable air to said plenum at a predetermined volume and pressure;

c. outlet means in said defining means for directing respirable air from said plenum downwardly therefrom; and d. means for securing said plenum to a head of a wearer, wherein said securing means comprises a hat with an outwardly extending brim, said brim having an upper surface, a lower surface, and a peripheral margin, and means for releasably attaching said defining means thereto.

2. An air delivery system as recited in claim 1, wherein said attaching means comprises a reverse curl flange extending along a periphery of said baffle member and curling over said peripheral margin of said brim for retention thereon.

3. An air delivery system as recited in claim 2, wherein said securing means includes strap means having ends secured thereto for biasing said flange against said securing means, said strap means including gasket means for sealing between said strap means and said flange.

4. An air delivery system as recited in claim 1, wherein said outlet means comprises a plurality of apertures in said defining means positioned for directing air downward over said wearer's face.

5. An air delivery system as recited in claim 1, wherein said means for providing respirable air to said plenum comprises:

a. fan means for supplying respirable air to said plenum;

b. portable means for powering said fan means;

c. control means for controlling said fan means;

d. said plenum including inlet means for introducing respirable air therein;

e. conduit means for providing fluid communication from said fan means to said inlet means; and, f. filter means for converting ambient air into respirable air, wherein said ambient air is drawn through said filter means by said fan means to said hose means.

6. An air delivery system as recited in claim 1, further comprising a face shield retainer support means rotatably supported by said securing means and a face shield affixed to said support means and extending downward therefrom such that said face shield may be inclined to cover said wearer's facial area.

7. An air delivery system as recited in claim 6, wherein said face shield further includes a face seal having a portion sealably affixed along a periphery of said face shield and having a resilient peripheral portion positioned against said wearer's upper neck area for restricting ambient air from intruding into said wearer's breathing zone.

8. An air delivery system comprising:

a. means for defining a plenum proximal the forehead of a wearer and extending outwardly therefrom, said defining means having and upper surface and a lower surface, with a baffle member extending over a portion of said lower surface;

b. means for providing respirable air to said plenum at a predetermined volume and pressure;

c. outlet means in said defining means for directing respirable air from said plenum downwardly therefrom; and d. means for securing said plenum to the head of a wearer, wherein said securing means comprises a helmet having a top portion, front portion, at least two side portions, and a rear portion, along with a brim portion extending outward from said front portion wherein said securing means includes means for releasably attaching said defining means thereto.

9. An air delivery system as recited in claim 8, wherein said outlet means comprises a plurality of apertures in said baffle positioned for directing air downward over said wearer's face.

10. An air delivery system as recited in claim 8, wherein said baffle comprises a flexible frame and a flexible arcuate strip extending away from said frame, said frame and said strip defining an air space therebetween, and wherein said frame and said strip are adapted to support a flexible foraminous material spanning said airspace.

11. An air delivery system as recited in claim 8, wherein said attaching means comprises a reverse curl flange extending along a periphery of said baffle member and curling over a peripheral margin of said brim for retention thereon.

12. An air delivery system as recited in claim 11, wherein said securing means includes strap means having ends secured thereto for biasing said flange against said securing means, said strap means including gasket means for sealing between said strap means and said flange.

13. An air delivery system as recited in claim 8, wherein said outlet means comprises a plurality of apertures in said baffle means positioned for directing air downward over said wearer's face.

14. An air delivery system as recited in claim 8, wherein said means for providing respirable air to said plenum comprises:

a. fan means for supplying respirable air to said plenum;

b. portable means for powering said fan means;

c. control means for controlling said fan means;

d. said plenum including inlet means for introducing respirable air therein;

e. conduit means for providing fluid conmuunication from said fan means to said inlet means; and, f. filter means for converting ambient air into respirable air, wherein said ambient air is drawn through said filter means by said fan means to said conduit means.

15. An air delivery system as recited in claim 8, further comprising a face shield retainer support means rotatably supported by said securing means and a face shield affixed to said support means and extending downward therefrom such that said face shield may be inclined to cover said wearer's facial area.

16. An air delivery system as recited in claim 15, wherein said face shield further includes a face seal having a portion sealably affixed along a periphery of said face shield and having a resilient peripheral portion positioned against said wearer's upper neck area for restricting ambient air from intruding into said wearer's breathing zone.

17. An air delivery system as recited in claim 15, wherein said face shield further includes a hood sealably affixed along a periphery of said face shield and extending to and laying against said wearer's upper torso so that ambient air is intruding into said wearer's breathing zone.

18. An air delivery system comprising:

a. means for defining a plenum proximal to the forehead of a wearer and extending outwardly therefrom;

b. means for providing respirable air to said plenum at a predetermined volume and pressure;

c. outlet means in said lower portion of said defining means for directing respirable air from said plenum downwardly therefrom; and d. means for securing said plenum to the head of a wearer, wherein said securing means comprises an eye wear product having a top frame portion and side temples for supporting said eye wear product on said wearer's head, said top frame portion supporting said defining means, and means for releasably attaching said defining means thereto.

19. An air delivery system as recited in claim 18, wherein said defining means comprises a baffle member having an upper portion and a lower portion, said portions having connected peripheral edges and spaced from one another for defining said plenum therebetween, said lower portion including said outlet means.

20. An air delivery system as recited in claim 18, wherein said securing means comprises a visor attached to and supported by said top frame portion, said visor having an upper surface and a lower surface, and an air distribution baffle attached to said lower surface.

21. An air delivery system as recited in claim 18, wherein said securing means includes strap means having ends secured thereto for biasing said securing means against said wearer's head.

22. An air delivery system as recited in claim 18, wherein said outlet means comprises a plurality of apertures in said lower portion of said baffle member positioned for directing air downward over said wearer's face.

23. An air delivery system as recited in claim 18, further comprising a face shield retainer support means rotatably supported by said securing means and a face shield affixed to said support means and extending downward therefrom such that said face shield may be inclined to cover said wearer's facial area.

24. An air delivery system comprising:

a. means for defining a plenum proximal to the forehead of a wearer and extending outwardly therefrom, wherein said defining means comprises a baffle member extending over a portion of a lower surface of said defining means;

b. means for providing respirable air to said plenum at a predetermined volume and pressure;

c. outlet means in said defining means for directing respirable air from said plenum downwardly therefrom; and d. means for securing said plenum to the head of a wearer, wherein said securing means comprises a visor having an upper surface and a lower surface, said visor positioned upon a wearer's forehead and extending away therefrom, said visor including side support members extending towards a rear portion of said wearer's head for supporting said visor on said wearer and means for releasably attaching said defining means thereto.

25. An air delivery system as recited in claim 24, wherein said baffle comprises a flexible frame and a flexible arcuate strip extending away from said frame, said frame and said strip defining an air space therebetween, and wherein said frame and said strip are adapted to support a flexible foraminous material spanning said airspace.

26. An air delivery system as recited in claim 24, wherein said outlet means comprises a plurality of apertures in said defining means positioned for directing air downward over said wearer's face.

27. An air delivery system as recited in claim 24, further comprising a face shield retainer support means rotatably supported by said securing means and a face shield affixed to said support means and extending downward therefrom such that said face shield may be inclined to cover said wearer's facial area.

28. An air delivery system as recited in claim 27, wherein said face shield further includes a face seal having a portion sealably affixed along a periphery of said face shield and having a resilient peripheral portion positioned against said wearer's upper neck area for restricting ambient air from intruding into said wearer's breathing zone.

* * * * *